US009440278B2

(12) United States Patent
Wang et al.

(10) Patent No.: US 9,440,278 B2
(45) Date of Patent: Sep. 13, 2016

(54) ROLLER HEMMING

(71) Applicants: GM Global Technology Operations LLC, Detroit, MI (US); Shanghai Jiao Tong University, Shanghai (CN)

(72) Inventors: Jeff Wang, Jiangsu (CN); Xianghuai Dong, Shanghai (CN); Yao Shen, Shanghai (CN); Jun Chen, Shanghai (CN)

(73) Assignees: GM Global Technologies Operations LLC, Detroit, MI (US); Shanghai Jiao Tong University, Shanghai (CN)

( * ) Notice: Subject to any disclaimer, the term of this patent is extended or adjusted under 35 U.S.C. 154(b) by 107 days.

(21) Appl. No.: 13/797,762

(22) Filed: Mar. 12, 2013

(65) Prior Publication Data

US 2014/0150514 A1 Jun. 5, 2014

(30) Foreign Application Priority Data

Nov. 30, 2012 (CN) ..... 2012 1 0501564

(51) Int. Cl.

*B21D 39/02* (2006.01)
*B21D 19/04* (2006.01)
*B21D 37/16* (2006.01)

(52) U.S. Cl.

CPC ..... *B21D 39/023* (2013.01); *B21D 19/043* (2013.01); *B21D 37/16* (2013.01)

(58) Field of Classification Search

CPC . B21B 39/023; B21B 45/004; B21D 39/023; B21D 37/74; B21D 37/16; C21D 1/40
USPC ..... 72/200, 202, 219, 220, 342.94, 312, 72/313, 314, 315, 342.96, 252.5; 219/50, 219/162, 81, 82, 83, 84; 29/419.2, 513; 901/17, 18
See application file for complete search history.

(56) References Cited

U.S. PATENT DOCUMENTS

| | | | | |
|---|---|---|---|---|
| 3,182,381 | A * | 5/1965 | Johnston et al. | 29/885 |
| 3,543,000 | A * | 11/1970 | Soller | 219/162 |
| 4,037,073 | A * | 7/1977 | Becker | 219/92 |
| 5,587,042 | A | 12/1996 | St. Denis | |
| 6,281,467 | B1 * | 8/2001 | Gould et al. | 219/118 |
| 6,927,370 | B2 | 8/2005 | McClure et al. | |
| 7,290,318 | B2 | 11/2007 | Bradley et al. | |

(Continued)

FOREIGN PATENT DOCUMENTS

| | | |
|---|---|---|
| CN | 201552232 | 8/2010 |
| DE | 10331205 | 1/2005 |

(Continued)

*Primary Examiner* — Shelley Self
*Assistant Examiner* — Gregory Swiatocha
(74) *Attorney, Agent, or Firm* — Dierker & Kavanaugh, P.C.

(57) ABSTRACT

Methods and apparatuses for roller hemming are disclosed herein. An example of a sheet metal roller hemming apparatus includes a first electrode to electrically connect to an electrical power supply and a sheet metal workpiece. The apparatus further includes a second electrode to electrically connect to the electrical power supply and the sheet metal workpiece to cause pulsed electric current to flow through a portion of the workpiece to locally increase formability in the portion of the workpiece. The apparatus still further includes a roller assembly to contact the workpiece to cause the workpiece to bend in the portion of the workpiece when the pulsed electric current is flowing through the portion of the workpiece, and to form a hem.

2 Claims, 11 Drawing Sheets

(56) References Cited

U.S. PATENT DOCUMENTS

| | | | | |
|---|---|---|---|---|
| 7,290,423 | B2 * | 11/2007 | Carsley et al. | 72/214 |
| 7,302,821 | B1 * | 12/2007 | Dariavach et al. | 72/342.96 |
| 7,770,955 | B2 | 8/2010 | Kleber et al. | |
| 8,042,372 | B2 | 10/2011 | Carsley et al. | |
| 2005/0284204 | A1 | 12/2005 | Carsley et al. | |
| 2006/0070418 | A1 * | 4/2006 | Quell | 72/214 |
| 2006/0091118 | A1 * | 5/2006 | Eldridge | B23K 9/0956 219/121.54 |
| 2008/0173619 | A1 * | 7/2008 | Scodeller et al. | 219/78.01 |
| 2008/0257007 | A1 * | 10/2008 | Golovashchenko et al. | 72/342.96 |
| 2009/0044590 | A1 * | 2/2009 | Roth | 72/342.96 |
| 2009/0241705 | A1 * | 10/2009 | Subramanian et al. | 74/89.21 |
| 2010/0257912 | A1 * | 10/2010 | Tiberghien et al. | 72/305 |
| 2011/0107807 | A1 * | 5/2011 | Sato et al. | 72/220 |
| 2011/0170946 | A1 * | 7/2011 | Schneegans et al. | 403/271 |
| 2011/0233173 | A1 * | 9/2011 | Kaneko et al. | 219/83 |
| 2011/0271728 | A1 | 11/2011 | Vanimisetti et al. | |

FOREIGN PATENT DOCUMENTS

| | | |
|---|---|---|
| EP | 1518617 | 3/2005 |
| JP | 2004351464 | 12/2004 |

* cited by examiner

ROLLER HEMMING

CROSS-REFERENCE TO RELATED APPLICATIONS

This application is based on and claims the benefit of priority from Chinese Patent Application No. 201210501564.4, filed on Nov. 30, 2012, the contents of which are incorporated by reference herein.

TECHNICAL FIELD

The present disclosure relates generally to roller hemming.

BACKGROUND

Roller hemming is a forming process which includes deforming a metal sheet into a hemmed configuration. For example, automotive components including doors, hoods, and tailgates may be hemmed. An example of a roller hemming process may include a flanging step and a hemming step. The flanging step creates a preliminary bend contour in the metal sheet, and the hemming step closes the hem so the edge is rolled flush to itself.

SUMMARY

Methods and apparatuses for roller hemming are disclosed herein. An example of a sheet metal roller hemming apparatus includes a first electrode to electrically connect to an electrical power supply and a sheet metal workpiece. The apparatus further includes a second electrode to electrically connect to the electrical power supply and the sheet metal workpiece to cause pulsed electric current to flow through a portion of the workpiece to locally increase formability in the portion of the workpiece. The apparatus still further includes a roller assembly to contact the workpiece to cause the workpiece to bend in the portion of the workpiece when the pulsed electric current is flowing through the portion of the workpiece, and to form a hem.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Roller hemming of a metal sheet is a process used, for example, in the automotive industry to form body panels and other components. Hemming certain materials at room temperature may be difficult due to poor formability of those materials. For example, room temperature hemming of magnesium and other like materials may be difficult, at least in part because these materials do not readily deform. Some methods of roller hemming have included heat assistance by laser or induction coils. Other methods of roller hemming have included electromagnetic force, which may provide increased ductility due to high speed deformation. Further, a Jewel effect appearance along the hemline may be difficult to achieve, for example, when roller hemming particular materials, such as aluminum and magnesium sheets. It is to be understood that a Jewel effect refers generally to a high quality appearance. With reference to a hemline, the Jewel effect includes the perceived sharpness of a hem edge and also the perceived gap between a panel hem edge and another panel.

Examples of the present disclosure include electric pulsing in roller hemming sheet metal, i.e., a workpiece. Examples of the present disclosure may increase formability and hemmability of the workpiece, thereby reducing deformation resistance of the sheet metal workpiece (i.e., locally reducing yield strength and increasing ductility of the workpiece). Examples of the present disclosure may also reduce process cycle time and improve finished-part surface quality of hemmed metal sheets, including aluminum and magnesium sheets. It is to be understood that the electric pulsing disclosed herein may increase formability in the workpiece due to both joule heating and an electroplasticity effect. This is unlike laser-assisted hemming processes that introduce heat alone to the workpiece. In contrast, the electroplasticity effect resulting from the electric pulsing may increase the formability of the workpiece by depinning dislocations from obstacles with electron wind assistance and/or magnetic field assistance. Electric pulsing according to examples of the present disclosure may anneal the workpiece, allowing a reduced force to be used to form a flange and hem on the workpiece.

Figure 1:
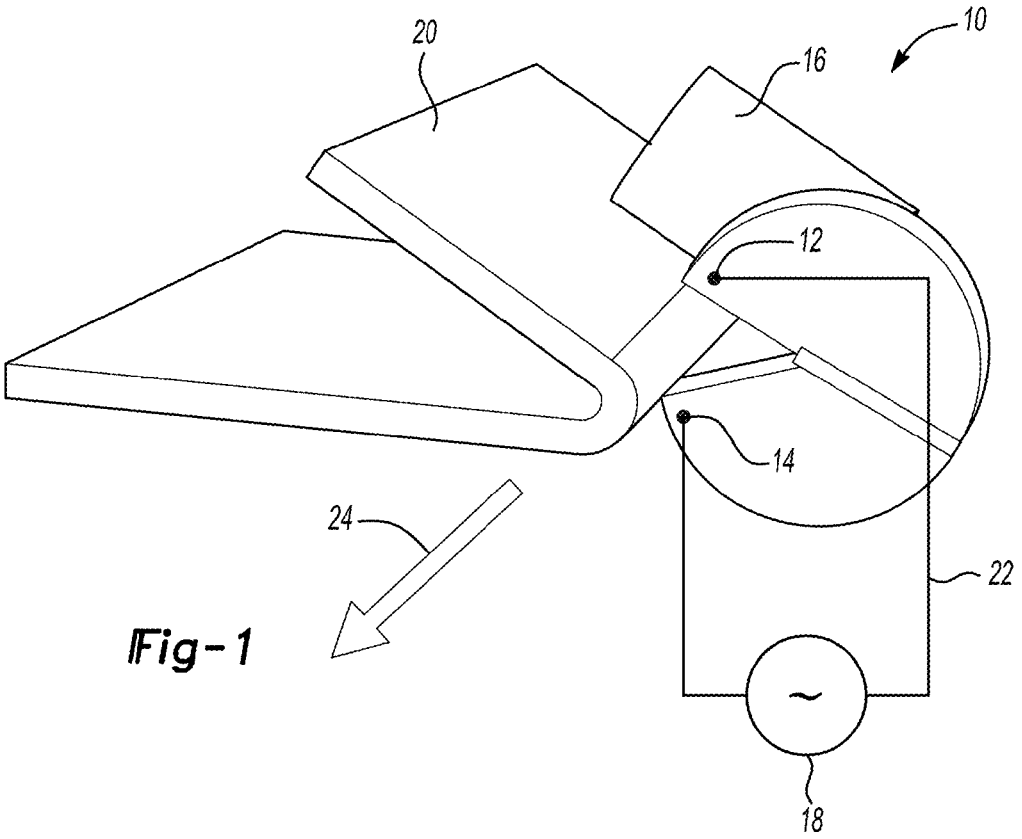
FIG. 1 is a schematic, perspective view of an example of a sheet metal roller hemming apparatus according to the present disclosure.

Referring now to FIG. 1, an example of a sheet metal roller hemming apparatus is depicted generally at 10. The hemming apparatus 10 includes a first electrode 12, a second electrode 14, and a roller assembly 16. The first electrode 12 may be electrically connected to an electrical power supply 18, and may be placed into electrical connection with the sheet metal workpiece 20. The second electrode 14 also may be electrically connected to the electrical power supply 18, and may be placed into electrical connection with the sheet metal workpiece 20. An electrical circuit, designated generally by 22, may include the first electrode 12, the second electrode 14, the sheet metal workpiece 20, and the electrical power supply 18. The electrical circuit 22 may cause pulsed electric current to flow through a portion of the workpiece 20 to locally increase formability of the portion of the workpiece 20. As will be discussed further below in reference to at least FIG. 4, it is also possible to use the roller assembly 16 as the first electrode 12 or the second electrode 14. Still further, in any of the examples disclosed herein, another (second) pair of electrodes (not shown) may be configured to follow the roller assembly 16 along the workpiece 20 to anneal the deformed area of the workpiece 20.

Figure 2:
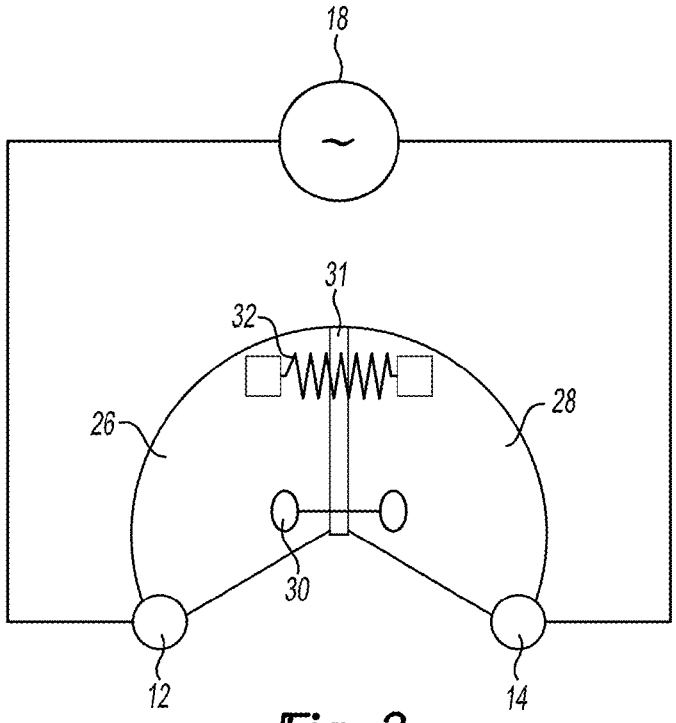
FIG. 2 is a schematic diagram depicting components of an example of a sheet metal roller hemming apparatus according to the present disclosure.

Referring briefly to FIG. 2, some components of the example of the hemming apparatus 10 of FIG. 1 are shown. The hemming apparatus 10 may have a hinged pivotal connection for accommodating contact of electrodes 12, 14 with the workpiece 20 (not shown in FIG. 2). FIG. 2 shows a first hinged element 26 and a second hinged element 28 pivotally connected by a hinge 30.

In an example, the first hinged element 26 and the second hinged element 28 may operate as the first electrode 12 and second electrode 14, respectively. In this example, each of the first hinged element 26 and the second hinged element 28 may be electrically conductive. The first and second hinged elements 26, 28 may be separated from one another by an insulator 31 made of, for example, phenolic plastic or another suitable insulating material. When the first and second hinged elements 26, 28 function as the electrodes 12, 14, the insulator 31 electrically isolates the two elements 26, 28.

In another example, the first hinged element 26 and the second hinged element 28 may be formed of electrically insulating materials (e.g., phenolic plastic), and these elements 26, 28 may hold electrically conductive components that operate, respectively, as first electrode 12 and second electrode 14. This example is shown in FIG. 2. The electrodes 12, 14 may be bonded to the first and second hinged elements 26, 28.

In any of the examples disclosed herein, the size of electrodes 12, 14 may range from about 5 mm to about 50 mm in diameter. Example electrode materials include aluminum, aluminum alloys, copper, brass, or other conductive or semi-conductive materials.

The angular position of the pivotal connection may be controlled by an actuator 32. The actuator 32 may be servo-hydraulic, pneumatic, electric motor driven, piezoelectric, etc., and may include screws, levers, and/or gears. Combinations of the shapes of hinged elements 26 and 28 with various positions of the actuator 32 allow for electrical contact to be maintained by the hemming apparatus 10. One example is shown in, and discussed in further detail with reference to FIGS. 3A-3D.

Figure 3A:
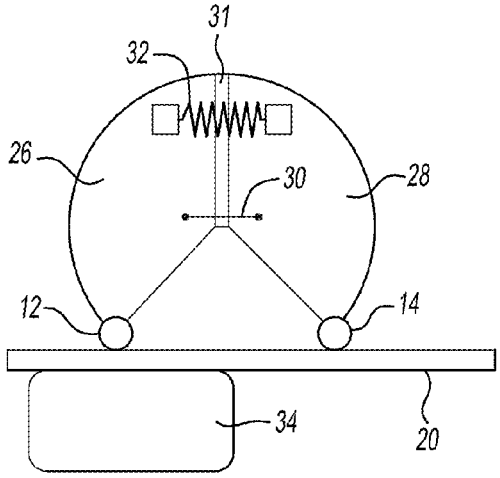
FIGS. 3A-3D are schematic diagrams depicting a method of using the apparatuses of FIGS. 1 and 2 according to the present disclosure.
Figure 3B:
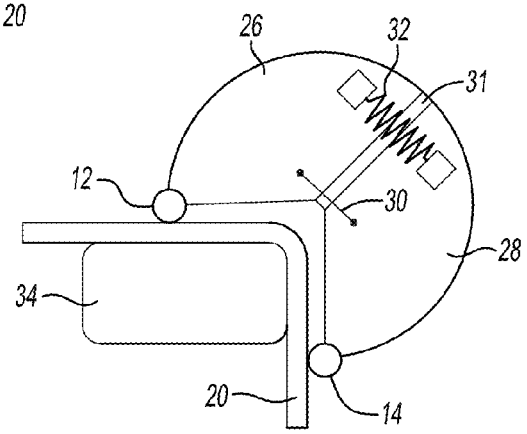

Referring back to FIG. 1, the roller assembly 16 may contact the workpiece 20 to cause the portion of the workpiece 20 to bend when the pulsed electric current is flowing through the portion of the workpiece 20. As such, pressure from the roller assembly 16 and pulsed electric current may be applied to the workpiece 20 simultaneously. The bending is caused by the roller assembly 16 contacting the workpiece 20 with application of sufficient force to plastically deform the workpiece 20. A first portion of the hemming process may form a flange edge on the workpiece 20. The flange edge may be formed by bending the portion of the workpiece 20 around a die form (e.g., as shown in FIGS. 3A and 3B designated by reference numeral 34). A second portion of the hemming process may form a finished hem on the workpiece 20. The finished hem may be formed by further bending of the flanged edge. As such, the hemming apparatus 10 (and 10', 10", and 10''', as discussed further below) may form a hem on the workpiece 20.

Figure 3C:
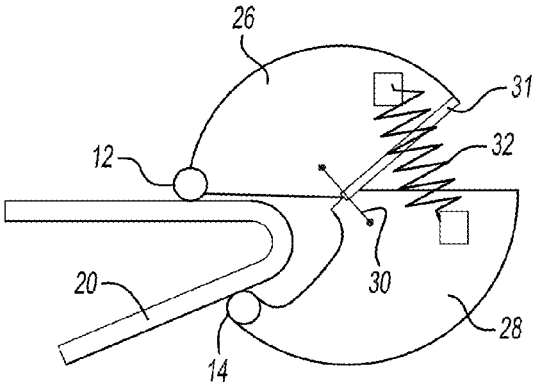
Figure 3D:
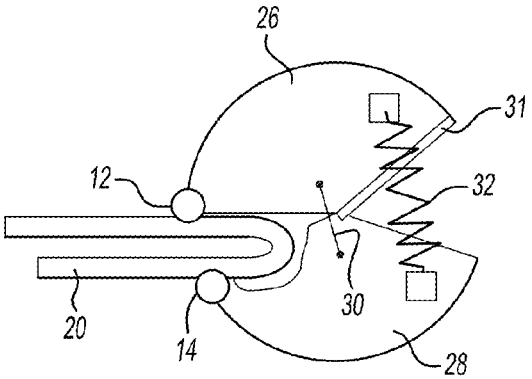

An example of a final hem may include a metal sheet that started as a substantially flat piece (e.g., as depicted in FIG. 3A), which has been bent, e.g., folded back upon itself as depicted in FIG. 3D. For example, a single sheet of metal may be used to form a hem at an edge surface thereof, where opposing face surfaces of the finished hem configuration are adjacent one another without an intervening member therebetween. It is to be understood, however, that opposing face surfaces of the finished hem configuration may have an intervening member pinched therebetween or may include an intervening void space captured therebetween. For example, a panel assembly may include a sheet of metal hemmed with another sheet of metal between the opposing face surfaces of the hemmed sheet. Further, examples of a final hem may include a gap between opposing face surfaces of the workpiece 20.

It is to be understood that the electrodes 12, 14 may be positioned in front of or behind the roller assembly 16 relative to a hemming direction 24. In other words, the electrodes 12, 14 may be placed in a leading position or in a trailing position relative to the hemming direction 24. Further, examples according to the present disclosure may include another (second) roller assembly (not shown) used to continue deforming the workpiece 20 after the (first) roller assembly 16 passes along the workpiece 20. For example, the roller assembly 16 may contact the workpiece 20, the electrodes 12, 14 may follow behind the roller assembly 16, and the second roller assembly may follow behind the electrodes 12, 14. Still further, other examples may include a second pair of electrodes (not shown) to be used in conjunction with the second roller assembly. For example, as a part of a single processing stage, a first pair of electrodes 12, 14 may pass along workpiece 20 followed by the roller assembly 16 to deform the workpiece 20 into a partially processed condition, and the second pair of electrodes may pass along the workpiece 20 followed by a second roller assembly to deform the workpiece 20 into a further processed condition. As mentioned above, the second set of electrodes may also be used to anneal the deformed areas of the workpiece.

In the examples disclosed herein, it is desirable to control the temperature in the deformation zone of the workpiece 20 (i.e., the area of the workpiece 20 that is deformed) as the electric pulse is applied. The temperature in the deformation zone may be controlled by adjusting a distance between the roller assembly 16 and the electrode(s) 12, 14 and/or by alternating the waveform of the electric pulse. The desirable temperature in the deformation zone depends upon the material(s) that is/are being used. For magnesium, the desirable temperature in the deformation zone ranges from about 200° C. to about 300° C. In general, if the deformation zone temperature is too high for a given material (which, in some instances, is below the melting temperature of the material), the process may result in a coarse grained microstructure which leads to the material having poor formability. Similarly, if the deformation zone temperature is too low, the material will also have limited formability.

In an example, the roller assembly 16 may be located within an electrically effective range from the first and second electrodes 12, 14. The electrically effective range may be from about 2 mm to about 30 mm. In an example, the electrically effective range is from about 5 mm to about 30 mm. The respective distances of the roller assembly 16 to the first electrode 12 and to the second electrodes 14 may vary depending on the material of the workpiece 20 and, as noted above, the temperature rise in the deformation zone of the workpiece 20 due to the electric pulsing. In an example, a desirable deformation zone temperature may be achieved (using the device depicted in FIG. 4) when the distance between the roller 17 and the electrode 12 is about 2 mm during the flanging step(s) (i.e., obtaining a 90° bend), and from about 5 mm to about 20 mm during the hemming step(s) (i.e., obtaining a 180° bend). In some instances, these distances are close to the thicknesses of the workpiece 20 during the respective steps.

It is to be understood that the pulsed electric current in the examples disclosed herein may have a triangular waveform with a very fast rising portion. The waveform may be a sawtooth type with a negative ramp, i.e., with an almost vertical rise and a slower decay. The decay may be exponential within microseconds. It is to be understood that the waveform may have a period ranging from about 2 microseconds to about 10 microseconds. The frequency may range from about 100 Hz to about 1,000 Hz. The current density applied may be from about 100 $A/mm^2$ to about 1,000 $A/mm^2$ The current density is calculated assuming uniform current flow across the whole cross section of contact. It is to be understood that strong, consistent electrical contact may ensure smooth passage of current into the deforming metal of the workpiece 20 and may avoid arcing, which may therefore avoid damage to the finished surface appearance.

It is further to be understood that power is delivered to the electrical circuit 22 by electrical power supply 18 after the electrodes 12, 14 are in contact with the workpiece 20. In an example, a sensor may be used to determine whether electrical contact is made between the electrodes 12, 14 and the workpiece 20. In another example, low voltage electric pulses may be initially applied to detect and ensure smooth electrical contact of the electrodes 12, 14 with the workpiece 20 prior to applying higher voltage electric pulsing for hemming. Electrical contact of the electrodes 12, 14 with the workpiece 20 may also be achieved with a contact paste or conductive lubricant. However, the use of such pastes or lubricants may be undesirable because of post-process washing or grinding that may be needed to remove such materials.

During power delivery, it is desirable to avoid electric arcing. It is to be understood that an appropriate spring force between the electrode 12, 14 and the workpiece 20 may help to avoid arcing. Surface cleaning and/or brushing of the workpiece 20 prior to hemming may also be performed to remove surface asperities from the workpiece 20. This also may help to avoid arcing.

In the example shown in FIG. 1, the pulsed electric current is applied to the workpiece 20 within the electrically effective range from the roller assembly 16. The current will increase the formability of the portion of the workpiece 20 receiving the pulsed electric current. The roller assembly 16 is utilized to form the hem along the portion.

FIGS. 3A-3D schematically depict examples of the first hinged element 26 (and the corresponding electrode 12) and the second hinged element 28 (and the corresponding electrode 14) maintaining contact with the workpiece 20 during steps of the hemming process. Contact is shown during the flanging steps, as depicted in FIGS. 3A and 3B, and during the hemming steps, as depicted in FIGS. 3C and 3D. The pulsed electric current is applied at least in the flanging step of FIG. 3B and the hemming steps of FIGS. 3C and 3D.

FIG. 3A illustrates an example of the electrodes 12, 14 contacting the workpiece 20 when the workpiece 20 is substantially flat. It is to be understood that workpiece 20 may be fixed in a position to be bent around die form 34 and may be fixed, for example, by a blank holder (e.g., as with blank holder 21 shown in FIG. 4), during flanging. FIG. 3B illustrates an example of the electrodes 12, 14 contacting the workpiece 20 when the workpiece 20 is partially bent around the die form 34. It is to be understood that workpiece 20 is bent to form an angle of approximately 90 degrees at the stage of flanging shown in FIG. 3B. As compared to FIG. 3A, FIG. 3B shows electrodes 12, 14 as being articulated in conjunction with workpiece 20 in order to maintain contact during hemming FIG. 3C illustrates a portion of a hemming step with relative articulation of the actuator 32. The relative articulation allows the first hinged element 26 to separate from the second hinged element 28 at the insulator 31, thereby allowing the electrodes 12, 14 to remain in contact, respectively, as the workpiece 20 is bent further in the hemming process. FIG. 3D illustrates another hemming step in which the first electrode 12 of the first hinged element 26 and the second electrode 14 of the second hinged element 28 maintain contact with the workpiece 20. It is to be understood that the shape of first hinged element 26 and second hinged element 28 may vary to accommodate various shapes and fixturing configurations of workpiece 20. For example, hinged element 28 may have a clearance or may deform to accommodate workpiece 20 as shown in FIGS. 3C and 3D.

Figure 4:
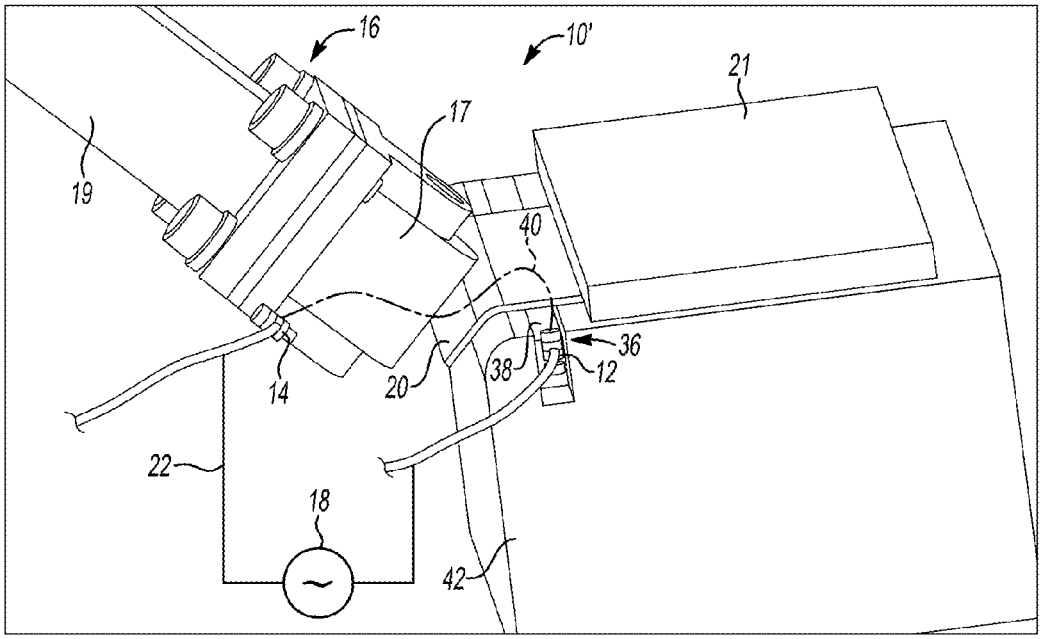
FIG. 4 is a semi-schematic, perspective view of another example of a sheet metal roller hemming apparatus according to the present disclosure.

It is to be understood that with the examples of roller hemming as disclosed herein, the workpiece 20 may or may not be manipulated (e.g., repositioned) by, or within, a fixture (not shown) between and/or during stages of the roller hemming process. In an example, the workpiece 20 may be initially held by the fixture in a certain position while forming a flange on the workpiece 20. The certain position may be retained with operation of a blank holder 21 (e.g., as shown in FIG. 4) clamping the workpiece 20 between opposing clamping surfaces of the blank holder 21 or between one clamping surface of the blank holder 21 and another surface (e.g., a surface of a busbar die form 42). The workpiece 20 may thereafter be repositioned relative to the blank holder 21, for example, by turning over the workpiece 20 within the blank holder 21 or beneath the blank holder 21. In an example, if a top clamping surface of the blank holder initially contacted a top surface of the workpiece 20 for clamping, upon repositioning the workpiece 20, the top clamping surface may thereafter contact a bottom surface of the workpiece 20 for clamping. It is to be further understood that various clamping mechanisms and/or die forms may be used to control the workpiece 20. For example, complex surface contours and edge shapes of the workpiece 20 may require custom tooling that may be used in accordance with the present disclosure.

In another example, a fixture (not shown) may hold the workpiece 20 with a fixed connection during the various stages of the hemming process. In one such example, the fixture may articulate relative to the roller assembly 16 in order to perform the flanging and hemming operations. For instance, the roller assembly 16 may remain stationary while the fixture articulates thereabout. Alternatively, the fixture may remain stationary while the roller assembly 16 articulates thereabout. Further, the fixture and the roller assembly 16 may each articulate, moving in a coordinated manner to process the workpiece 20 in the flanging and/or hemming operation. For example, the fixture may be in motion while the workpiece 20 is also in motion.

FIG. 4 depicts another example of a roller hemming apparatus 10'. This example includes roller assembly 16 operatively disposed as an end effector on a robotic arm 19. This example also includes a busbar 36 to serve as the first electrode 12. It is to be understood that the busbar 36 includes an electrical conductor 38 positioned to be in electrical contact with workpiece 20. As such, the busbar 36, via the electrical conductor 38, may provide for electrical contact with the workpiece 20 as the roller assembly 16 travels along the workpiece 20. The busbar 36 may also be clamped to the workpiece 20.

FIG. 4 also depicts the roller assembly 16 with the second electrode 14 electrically connected thereto. FIG. 4 further depicts an example electric current pathway as indicated by phantom line 40. The electric current pathway 40 may generally follow a path from the second electrode 14 through a portion of the roller assembly 16 and out through a roller 17 to contact the workpiece 20 and ultimately the first electrode 12. It is to be understood that the electric current pathway 40 is approximate and may vary depending on the configuration of workpiece 20 (including shape and material) and the positioning of roller assembly 16 relative to electrode 12, 14, etc.

In this example, the roller 17 is the portion of the roller assembly 16 which is intended to contact the workpiece 20 for hemming. The roller 17 may be formed of a material that is relatively soft yet has sufficient stiffness and strength at temperatures up to at least 400° C. The roller material may have appropriate surface hardness and rigidity to achieve predetermined dimensional requirements and surface quality of the workpiece 20 after deformation. Further, the roller 17 may be conductive because (as mentioned above) it may be part of the electric circuit 22 (and the electric current pathway 40). As an example, tool steel may be an appropriate option for the roller 17 when roller hemming aluminum and/or magnesium sheets. An example tool steel roller may have a surface hardness ranging from about 50 HRC to about 55 HRC. It is to be understood that "HRC" means Rockwell C-scale hardness measurement units.

Figure 5A:
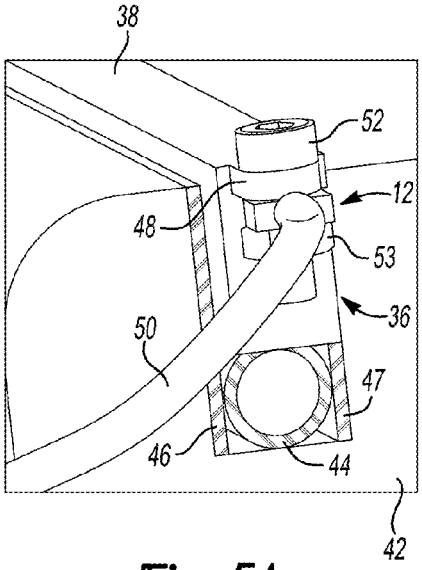
FIGS. 5A-5B are semi-schematic, perspective views of an example of a busbar according to the present disclosure.
Figure 5B:
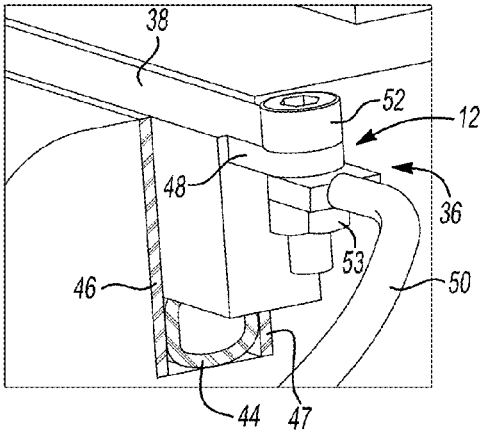

FIGS. 5A and 5B depict an example of the busbar 36 with electrical isolation components in an elevated stage and a depressed stage, respectively. Busbar 36 is shown with rubber insulation components (e.g., reference numerals 44, 46, 47) positioned between the busbar 36 and a busbar die form 42. It is to be understood that the rubber insulation components provide electrical isolation of the electrical components of the busbar 36 from the busbar die form 42. Shown, for example, are a rubber cylinder 44 and rubber busbar side walls 46 and 47 placed within busbar die form 42 to electrically isolate the electrical conductor 38 of the busbar 36 from the busbar die form 42. In the elevated stage, the insulation components 44, 46, 47 may push the electrical conductor 38 to extend beyond the surface of the busbar die form 42.

FIG. 5B shows the busbar 36 (and the electrical conductor 38) in a depressed state, i.e., when the electrical conductor 38 is depressed by the workpiece 20 (which has been removed for clarity). In this state, better electrical contact is achieved between the workpiece 20 and the electrical conductor 38 due, at least in part, to a recovering force of the compressed rubber component 44. This depressed state (with force applied on the workpiece 20 from the busbar 36) may help to avoid arcing.

It is to be further understood that other insulating materials (e.g., polymers, composite insulating materials, or other insulating materials) may be used as the electrical isolation components in place of the rubber insulation components.

In both FIGS. 5A and 5B, the busbar 36 is shown in electrical connection with a clamping tab 48, which connects a wire 50 to busbar 36. Attachment of the wire 50 to clamping tab 48 is shown using fasteners, including a bolt 52 and a nut 53. It is to be understood that other fastening means may be used also, e.g., welding, spring clips, etc.

Figure 6A:
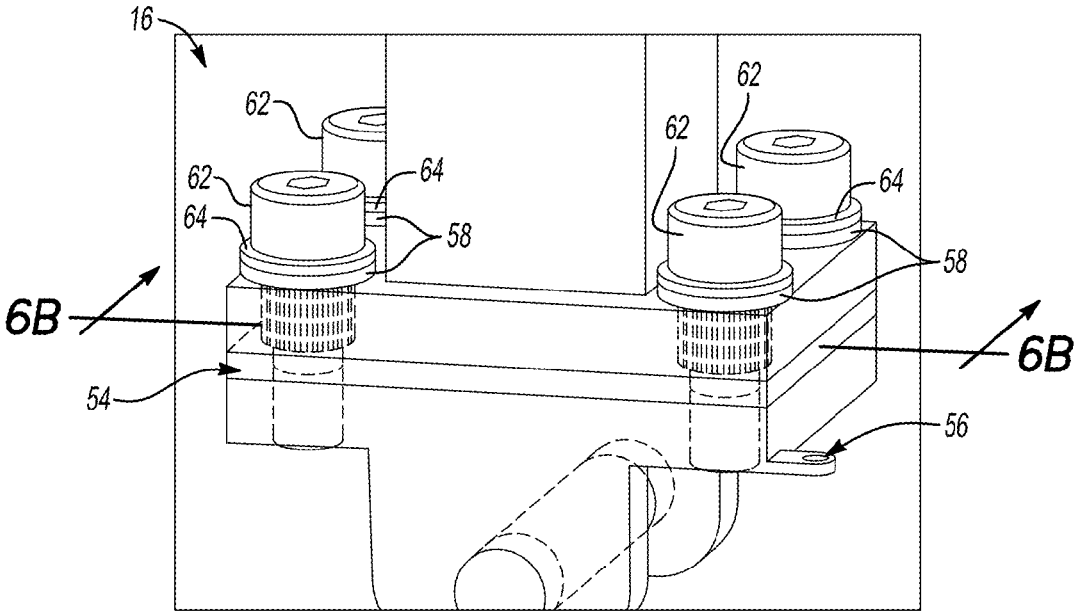
FIG. 6A is a semi-schematic, perspective view of an example of an electrical isolation mechanism of a roller assembly according to the present disclosure.
Figure 6B:
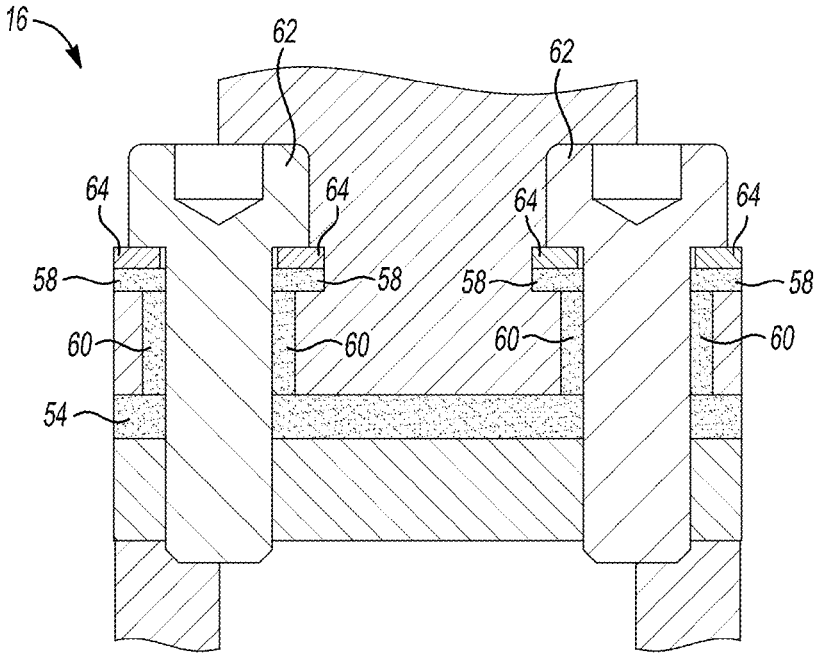
FIG. 6B is a semi-schematic, cross-sectional view of the electrical isolation mechanism taken along the 6B-6B line of FIG. 6A.

FIGS. 6A and 6B depict an example of a portion of the roller assembly 16 as shown in FIG. 4. These figures illustrate electrical isolation of certain components of the roller assembly 16 so that a current pathway may be isolated within the roller assembly 16 in a desirable manner. Insulation components are included for electrically isolating the current pathway (not shown) within the roller assembly 16. In this example, the current pathway generally follows a path from a roller assembly clamping tab 56 to the roller 17 (not shown in FIGS. 6A and 6B) for contact with the workpiece 20. Electrical isolation of the tab 56 and the roller 17 from the remainder of the roller assembly 16 may be provided by insulation layer 54, insulating washers 58, and insulating cylinders 60, which are fastened to roller assembly 16 by allen head cap screws 62 with washers 64. It is to be understood that insulation layer 54, insulating washers 58, and insulating cylinders may be made of various insulating materials as discussed above with reference to the insulating components of the busbar 36. It is further to be understood that while cap screws 62 and washers 64 are shown in FIGS. 6A and 6B, other fastening means may be used, e.g., welding, spring clips, etc.

Figure 7A:
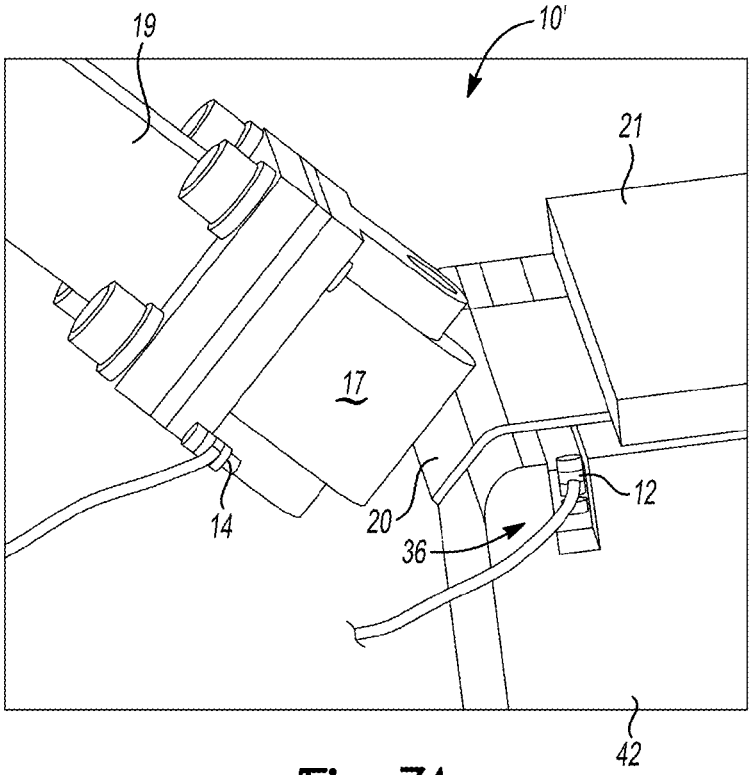
FIGS. 7A and 7B are semi-schematic, perspective views of the other example of the sheet metal roller hemming apparatus according to the present disclosure during a flanging step and a hemming step, respectively.
Figure 7B:
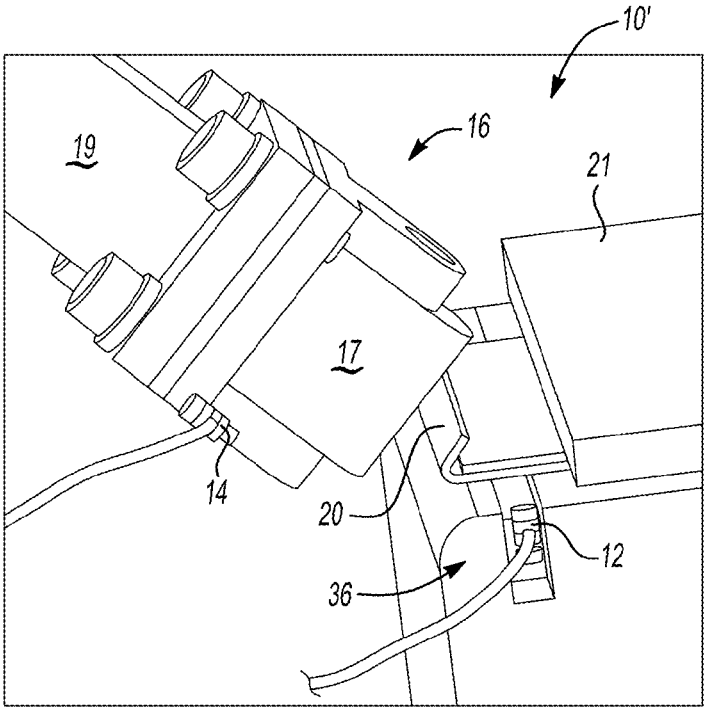

FIGS. 7A and 7B show an example of the hemming apparatus 10' in operation, performing a flanging step and a hemming step, respectively. FIG. 7A is substantially similar to FIG. 4. At this step, the pulsed electric current is applied to the workpiece 20 as the roller 17 glides along the workpiece 20 to form a flange. The pulsed electric current enhances/improves the formability of the deformed portion of the workpiece 20 so that less force (e.g., compared to the force applied during traditional hemming) may be applied to the workpiece by the roller 17 in order to form the flange. Between the steps shown in FIGS. 7A and 7B, the workpiece 20 is repositioned with respect to the blank holder 21 so that the flange can be further folded. In FIG. 7B, the pulsed electric current is continuously applied as the roller assembly 16 continues to process the workpiece 20 from the flanged condition into a hemmed condition.

FIGS. 8A-8F depict still another example of a roller hemming apparatus 10". In this example, the first electrode 12 is part of the roller assembly 16 and the second electrode 14 is disposed on a wiper 66. The first electrode 12 in this example is electrically connected to the roller 17 through the roller assembly clamping tab 56 as previously described in reference to FIGS. 6A and 6B. The wiper 66 is to provide for sliding electric contact on the workpiece 20. The wiper 66 may be operable to translate relative to the workpiece 20 with the roller assembly 16.

Figure 8A:
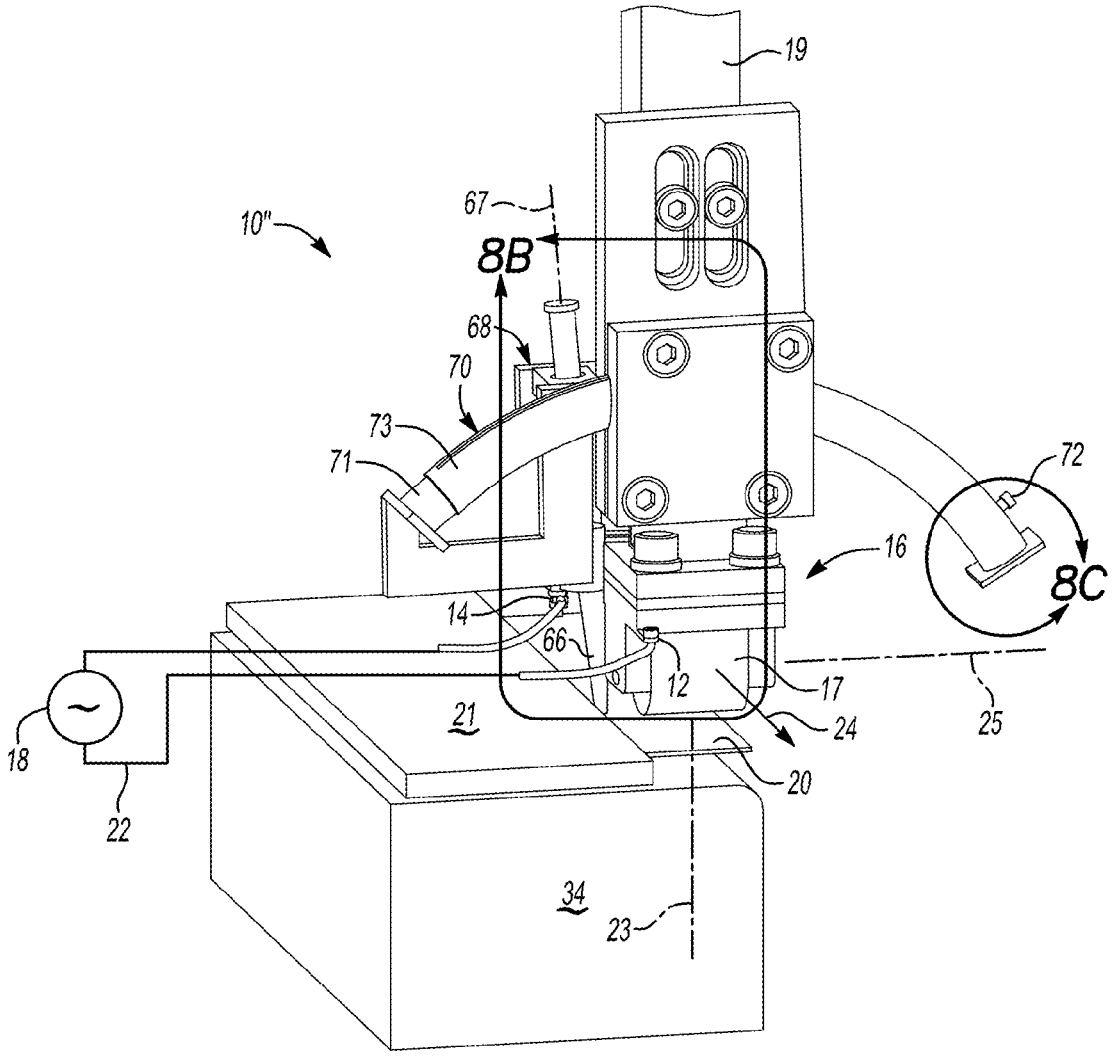
FIG. 8A is a semi-schematic, perspective view of still another example of a sheet metal roller hemming apparatus according to the present disclosure.
Figure 8B:
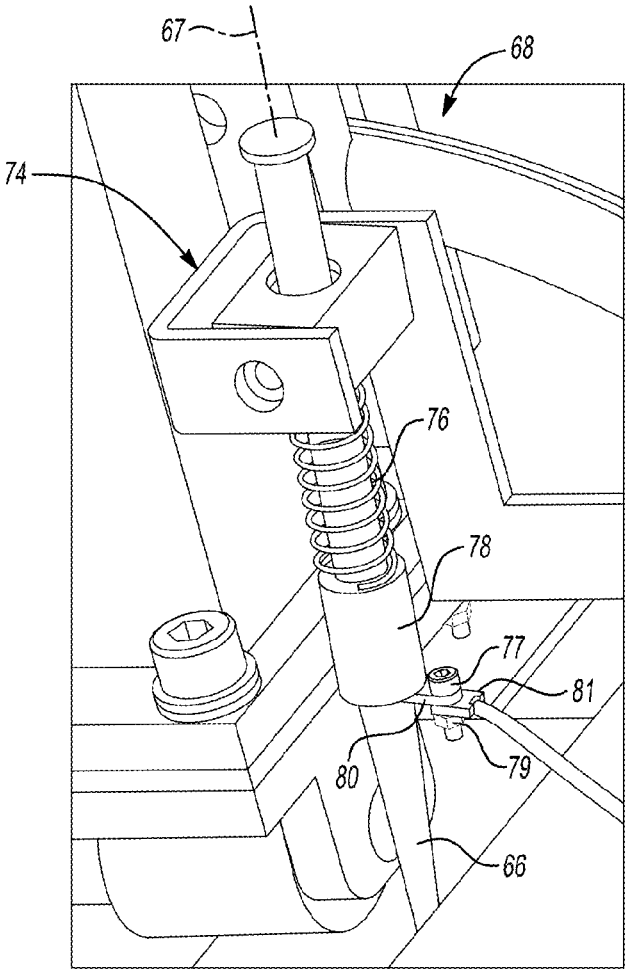
FIG. 8B is a semi-schematic, enlarged perspective view of a portion of the example of the sheet metal roller hemming apparatus of FIG. 8A.

Referring primarily to FIG. 8B, wiper 66 may be retained within a bracket assembly 74 and may be operable for axial translation along wiper primary axis 67 relative to bracket assembly 74. Wiper 66 may operate with a spring 76 and an insulating collar 78 between the bracket assembly 74 and a wiper clamping tab 80. The spring 76 operates to urge the wiper 66 into contact with the workpiece 20 by applying a force on the wiper 66 against the bracket assembly 74. Wiper clamping tab 80 receives electrical connection for wiper 66 by means of a bolt 77 and nut 79 to clamp the wiper clamping tab 80 and a wire 81 (i.e., electrode 14) together. Wiper clamping tab 80 may maintain electrical connection with wiper 66 by fastening means similar to that described for the electrical connection of busbar 36 of FIGS. 5A and 5B. The wiper 66 has sufficient electrical conductivity and may be made of copper, graphite, etc. An electric brush may be installed at one end of the wiper 66 to ensure sufficient electric contact, for example, during relative motion between the wiper 66 and the workpiece 20. In an example, the surface contact patch of wiper 66 may be 5 mm×5 mm (25 $mm^2$)

FIGS. 8A, 8B, 8C, and 8F show details of fixturing for the wiper 66 including positioning of the wiper 66 relative to the roller assembly 16. In an example, the wiper 66 and the roller assembly 16 are mounted for respective motion therebetween on a common frame mounting 68. The common frame mounting 68 may include various supporting structures for holding the wiper 66 and roller assembly 16 in position to contact the workpiece 20. In an example, common frame mounting 68 may include an arcuate telescoping connection 70 to control a respective position of the wiper 66 and the roller assembly 16.

Figure 8C:
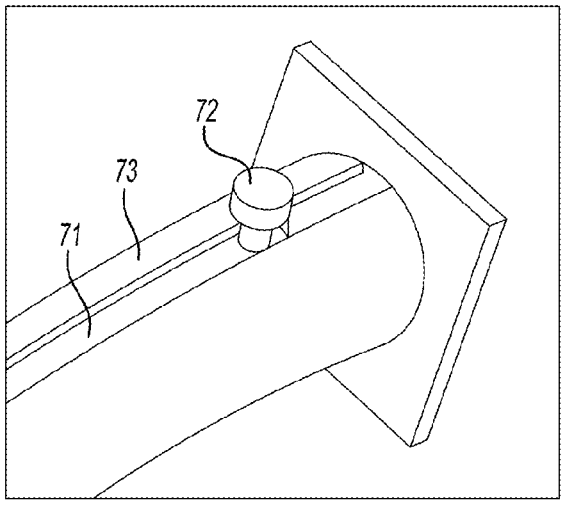
FIG. 8C is a semi-schematic, enlarged perspective view of another portion of the example of the sheet metal roller hemming apparatus of FIG. 8A.

Referring primarily to FIGS. 8A and 8C, in an example, the arcuate telescoping connection 70 may include an inner tube section 71 and an outer tube section 73 to translate with respect to one another. The inner tube section 71 may be operable to travel within the outer tube section 73, i.e., inner tube section 71 may telescope from within outer tube section 73. Extending the inner tube section 71 out from within the outer tube section 73, i.e., exposing more of the inner tube section 71, creates a greater angle between the wiper primary axis 67 (shown in FIG. 8B) and a roller assembly axis 23 (shown in FIG. 8A). The roller assembly axis 23 is defined as a line passing approximately through the point of contact of the roller 17 (with the workpiece 20) and extending substantially perpendicular to the hemming direction 24 and substantially perpendicular to a roller primary axis 25 (shown in FIG. 8A). A set screw 72 may be operable to fix the angular position of the wiper 66 relative to the roller assembly 16. The set screw 72 may also be used as a stop in order to prevent the inner tube section 71 from protruding beyond the outer tube section 73. In this way, the inner tube section 71 remains inside the outer tube section 73. It is to be understood that various fastening means may be used to fix the angular position of the wiper 66 relative to the roller assembly 16, e.g., spring clips, cotter pins, etc.

Figure 8D:
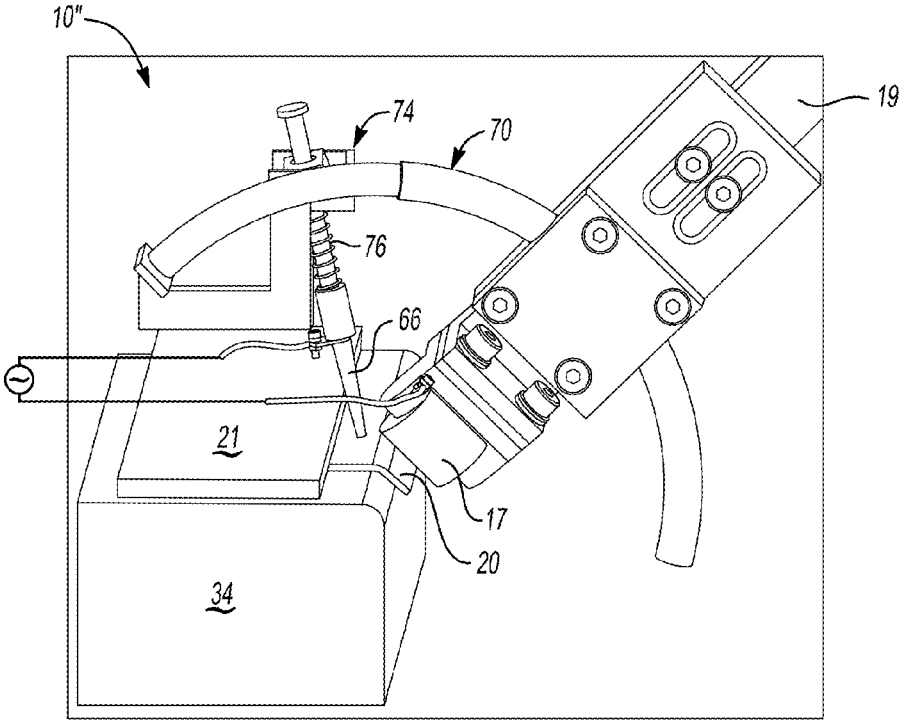
FIGS. 8D and 8E are semi-schematic, perspective views of the example of the sheet metal roller hemming apparatus of FIG. 8A during a flanging step and a hemming step, respectively.
Figure 8E:
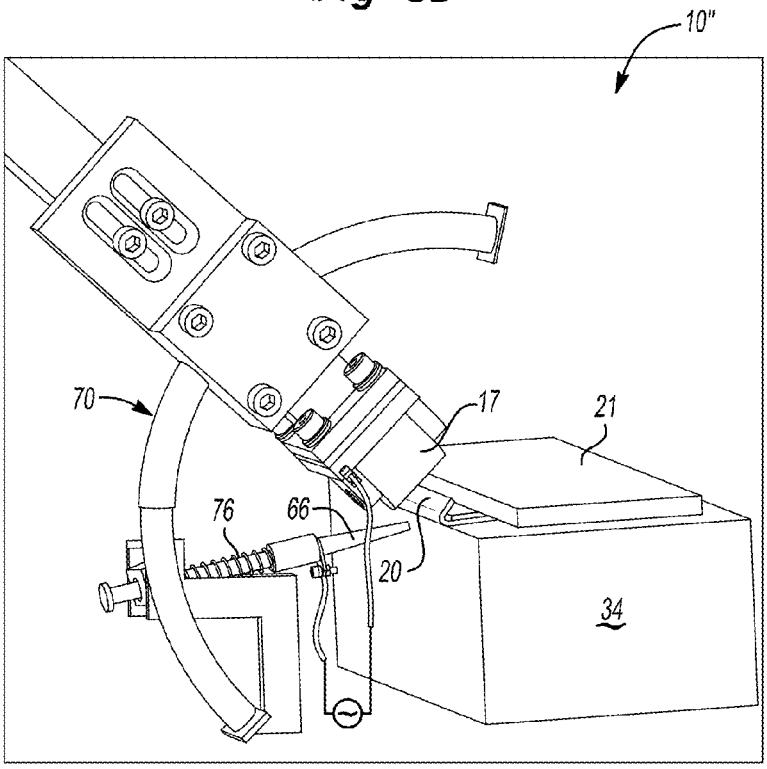

FIGS. 8D and 8E depict two stages of an example roller hemming process and two configurations of wiper contact and electrical pathways. In an example, wiper 66 may contact the workpiece 20 as shown in a flanging step as depicted in FIG. 8D. In another example, wiper 66 may contact die form 34 as shown in a hemming step as depicted in FIG. 8E. It is to be understood that various configurations of wiper contact may be required for flanging and hemming steps with various workpiece shapes and configurations of fixturing the workpiece 20 for processing. For example, the wiper 66 may contact a top surface of workpiece 20 in one step, and the wiper 66 may contact the die form 34 in another step. When the wiper 66 contacts the die form 34, it is to be understood that the die form is conductive in order to apply the pulsed electric current to the workpiece 20 sitting on the die form 34.

Figure 8F:
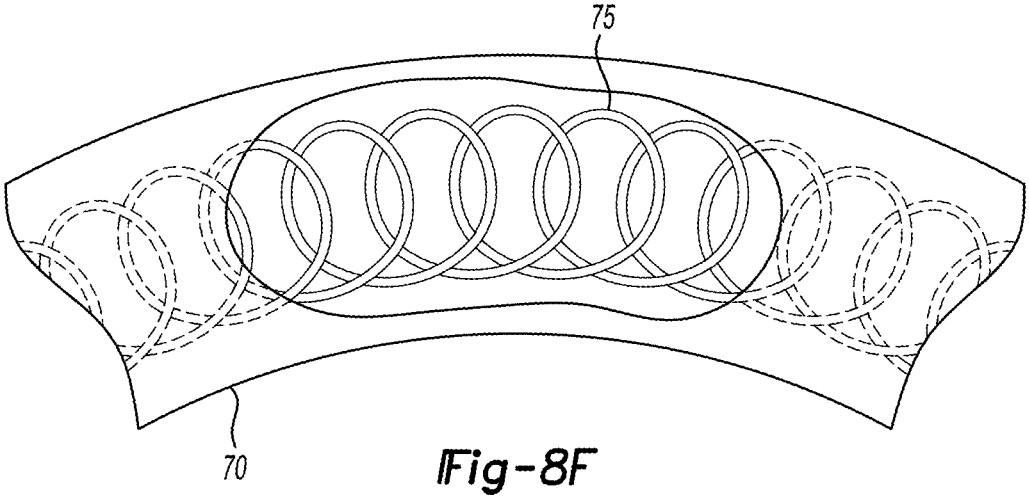
FIG. 8F is a semi-schematic, enlarged cutaway-perspective view of an arcuate telescoping connection of the example of the sheet metal roller hemming apparatus of FIG. 8A.

As shown in the cutaway view of FIG. 8F, inside the arcuate telescoping connection 70, a coil spring 75 may be positioned within inner tube section 71 and outer tube section 73. Coil spring 75 may operate to assist in manipulating the angular position of the wiper 66 relative to the roller assembly 16. For example, coil spring 75 may provide resistance between inner and outer tube sections 71, 73.

Figure 9A:
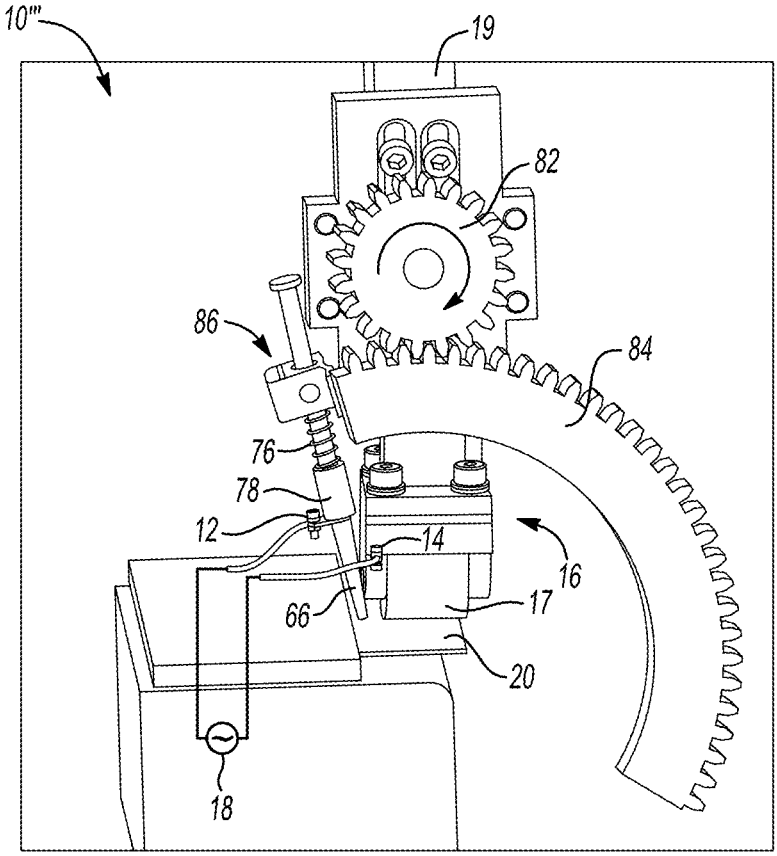
FIG. 9A is a semi-schematic, perspective view of yet another example sheet metal roller hemming apparatus.
Figure 9B:
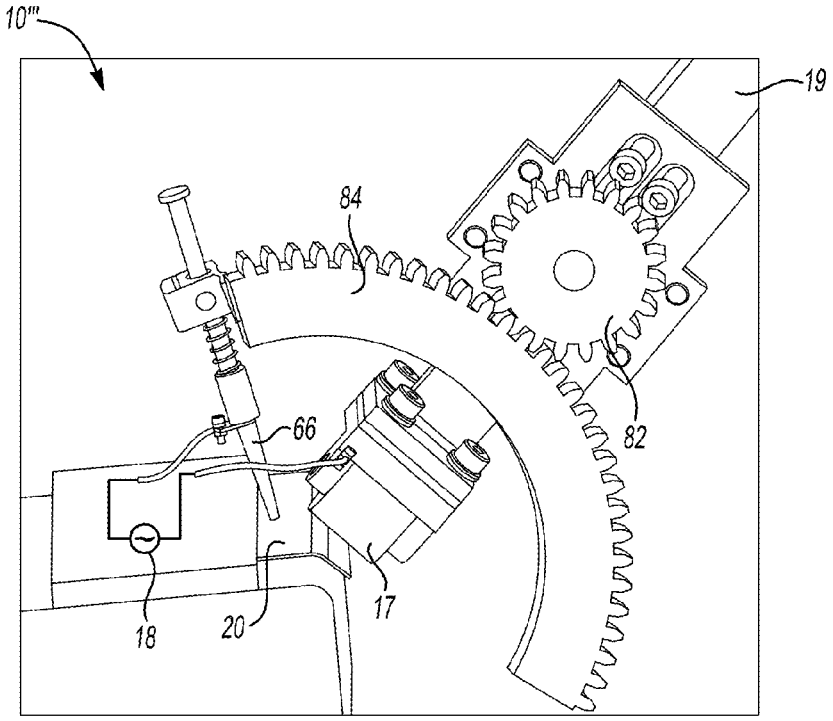
FIGS. 9B and 9C are semi-schematic, perspective views of the example sheet metal roller hemming apparatus of FIG. 9A during a flanging step and a hemming step, respectively.
Figure 9C:
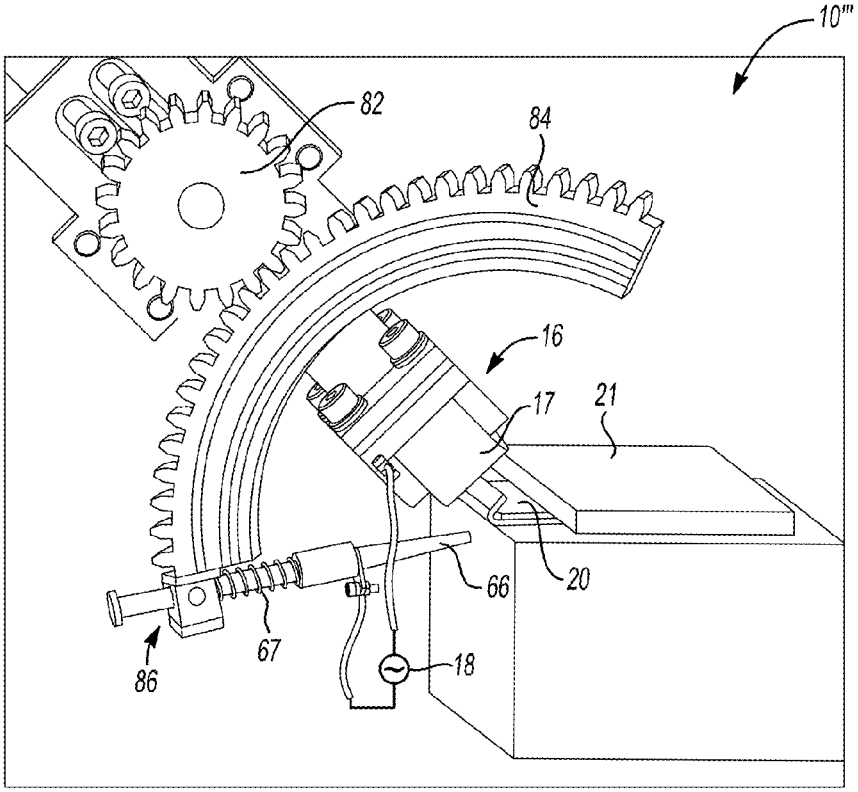

FIGS. 9A-9C depict still another example of the roller hemming apparatus 10''' with the roller assembly 16 and the wiper 66 having a geared connection 82, 84 to control a respective position of the wiper 66 and the roller assembly 16. An angular position of the wiper 66 relative to roller 17 may be controlled by a driving gear 82 having teeth that meshingly engage driven gear teeth, for example, as shown on a toothed arcuate section 84 in FIGS. 9A-9C. Toothed arcuate section 84 may be operably connected to wiper 66 by a bracket assembly 86. Details of operation of wiper 66 including spring 76, electrical connection of electrode 14, and contact with workpiece 20 are similar to that discussed above with reference to FIGS. 8A-8F. It is to be understood that various other mechanisms may be used to assist in positioning the toothed arcuate section 84, e.g., actuators that are servo-hydraulic, pneumatic, electric motor driven, piezoelectric, etc. and may include screws, levers, and/or gears, etc.

To further illustrate the present disclosure, examples are given herein. It is to be understood that these examples are provided for illustrative purposes and are not to be construed as limiting the scope of the present disclosure.

EXAMPLES

Comparative Example 1

Figure 10A:
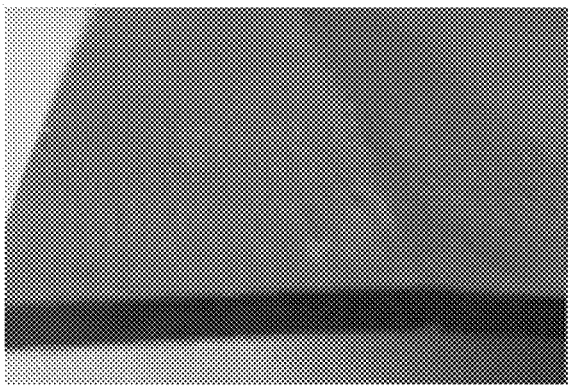
FIG. 10A is a black and white representation of an originally colored optical microscopy photograph showing a top, perspective view of a portion of a comparative test bend formed via a traditional bending process.
Figure 10B:
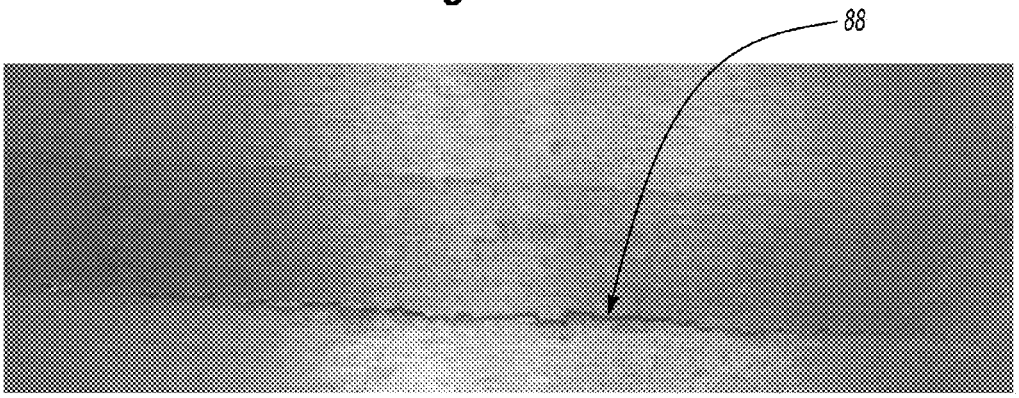
FIG. 10B is a black and white representation of an originally colored optical microscopy photograph showing a bottom surface of the comparative test bend shown in FIG. 10A.

FIGS. 10A and 10B depict a top, perspective view and a bottom surface view of a magnesium sheet that was exposed to a hemming process without the pulsed electric current of the present disclosure. In this comparative example, the magnesium sheet was used as the workpiece and hemming was attempted using a traditional process. The magnesium sheet was exposed to flanging, but the sheet cracked after slight bending was performed. FIG. 10A illustrates the top and one side of the workpiece. As shown on the bottom portion of the side, a cracking line 88 formed in the workpiece as a result of the hemming process. FIG. 10B is a view of the bottom surface of the workpiece showing the cracking line 88 extending along the bottom surface of the workpiece.

Example 2

Figure 11A:
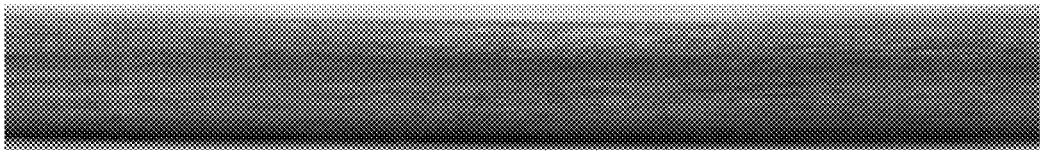
FIG. 11A is a black and white representation of an originally colored optical microscopy photograph showing a front view of a curved hemmed surface of an example test hemmed workpiece formed via a method according to the present disclosure.
Figure 11B:
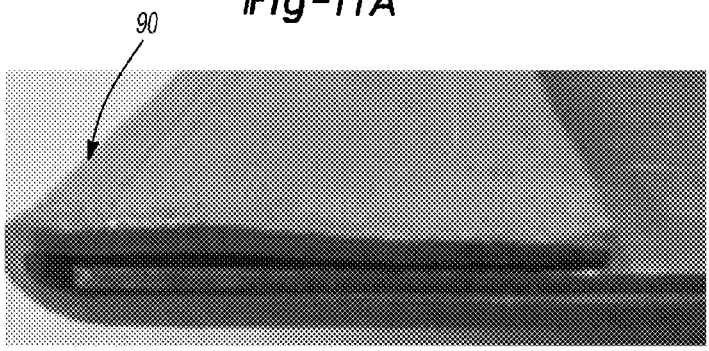
FIG. 11B is a black and white representation of an originally colored optical microscopy photograph showing a side perspective view of the example test hemmed workpiece shown in FIG. 11A.

FIGS. 11A and 11B depict different views of another magnesium sheet that was bent using the electric pulse assisted roller hemming process according to the present disclosure. In this example, the magnesium sheet was used as the workpiece, and was hemmed with a second magnesium sheet (as shown in FIG. 11B). Using a device similar to that shown in FIG. 4, the magnesium sheet was exposed to six different passes of the roller 17, which functioned as one of the electrodes. The other electrode was a busbar (similar to busbar 36). During the flanging stage, three roller passes were performed to continuously bend the magnesium sheet to achieve a 90° bend. The workpiece was then flipped over 180°, and the second magnesium sheet was placed onto the workpiece so that an edge of the second magnesium sheet abutted the 90° bend. During the hemming stage, three roller passes were performed to continuously form the hem edge 90 shown in FIG. 11B. The electric pulse was applied to the magnesium sheet throughout both the flanging stage and the hemming stage. For each pass, the travel velocity of the roller was 20 mm per minute. FIG. 11A depicts a view facing the curved surface of the hemmed edge 90. FIG. 11B depicts a perspective side view including hemmed edge 90. Unlike Comparative Example 1, no cracks formed in the magnesium workpiece after electric pulse assisted bending was performed.

It is to be understood use of the words "a" and "an" and other singular referents may include plural as well, both in the specification and claims, unless the context clearly indicates otherwise.

It is to be understood that the terms "connect/connected/connection" and/or the like are broadly defined herein to encompass a variety of divergent connected arrangements and assembly techniques. These arrangements and techniques include, but are not limited to (1) the direct communication between one component and another component with no intervening components therebetween; and (2) the communication of one component and another component with one or more components therebetween, provided that the one component being "connected to" the other component is somehow in operative communication with the other component (notwithstanding the presence of one or more additional components therebetween).

It is to be understood that the ranges provided herein include the stated range and any value or sub-range within the stated range. For example, a range from about 100 Hz to about 1,000 Hz should be interpreted to include not only the explicitly recited limits of about 100 Hz to about 1,000 Hz, but also to include individual values, such as 120 Hz, 500 Hz, 800 Hz, etc., and sub-ranges, such as from about 100 Hz to about 210 Hz, from about 800 Hz to about 950 Hz, etc. Furthermore, when "about" is utilized to describe a value, this is meant to encompass minor variations (up to +/−10%) from the stated value.

While several examples have been described in detail, it will be apparent to those skilled in the art that the disclosed examples may be modified. Therefore, the foregoing description is to be considered non-limiting.

The invention claimed is:

1. A sheet metal roller hemming apparatus, comprising:

a first electrode to electrically connect to an electrical power supply and a sheet metal workpiece, wherein the first electrode is a busbar including an electrical conductor positioned to be in electrical contact with the workpiece;

a second electrode to electrically connect to the electrical power supply and the sheet metal workpiece to cause pulsed electric current having a pulse frequency from about 100 Hz to about 1000 Hz to flow through a portion of the workpiece to locally increase formability in the portion of the workpiece via an electroplasticity effect and to form a hem, wherein the second electrode is a roller assembly; and rubber insulation components positioned between the busbar and a die form that supports the busbar, wherein the rubber insulation components include a rubber cylinder and two rubber busbar side walls placed within the die form to electrically isolate the busbar from the die form and wherein the rubber cylinder urges the busbar into contact with the sheet metal workpiece.

2. The sheet metal roller hemming apparatus as defined in claim 1 wherein the busbar is clamped to the workpiece.

* * * * *